United States Patent [19]

Sand et al.

[11] Patent Number: 4,829,786

[45] Date of Patent: May 16, 1989

[54] FLOODED EVAPORATOR WITH ENHANCED OIL RETURN MEANS

[75] Inventors: James R. Sand, Oak Ridge, Tenn.; James C. Wendschlag, Pueblo, Colo.

[73] Assignee: American Standard Inc., New York, N.Y.

[21] Appl. No.: 232,075

[22] Filed: Aug. 15, 1988

[51] Int. Cl.[4] ..... F25B 43/02

[52] U.S. Cl. ..... 62/468; 62/84; 184/109; 252/68

[58] Field of Search ..... 62/84, 468, 470; 184/6.23, 109; 252/67, 68

[56] References Cited

U.S. PATENT DOCUMENTS

| | | | |
|---|---|---|---|
| 3,092,981 | 8/1955 | Begeman et al. | 62/468 |
| 3,375,197 | 3/1968 | Spauschus et al. | 62/84 |
| 3,584,457 | 6/1971 | Davoud | 184/109 |
| 3,792,755 | 2/1974 | Sanvordenker | 181/33 |
| 3,805,918 | 4/1974 | Altgelt et al. | 184/109 |
| 4,442,015 | 4/1984 | Packo et al. | 252/68 |
| 4,474,019 | 10/1984 | Albert | 62/84 |
| 4,622,048 | 11/1986 | Roberts et al. | 55/199 |
| 4,662,190 | 5/1987 | Tischer | 62/470 |
| 4,702,089 | 10/1987 | Olson | 62/471 |

*Primary Examiner*—Ronald C. Capossela

*Attorney, Agent, or Firm*—William J. Beres; David L. Polsley; Robert J. Harter

[57] ABSTRACT

A lubricant composition with decreased solubility in a liquid refrigerant and increased foaming characteristics useful in refrigeration systems to promote oil return to a compressor. A lubricant composition comprises a base lubricant, synthetic paraffinic oil, and a foaming agent. These ingredients are blended in predetermined amounts, so that when the lubricant is used in the refrigeration system, an oil rich layer will form atop the liquid refrigerant in the system's flooded evaporator, and a thick, stable foam will form when vaporized refrigerant boils up through the oil rich layer. The oil foam is then drawn through a connection at the top of the flooded evaporator and returned to the compressor.

35 Claims, 2 Drawing Sheets

FLOODED EVAPORATOR WITH ENHANCED OIL RETURN MEANS

BACKGROUND OF THE INVENTION

This invention pertains to a refrigeration apparatus having a flooded evaporator, and more particularly to lubricants with decreased solubility and fluorocarbon refrigerants and increased foaming characteristics.

In refrigeration systems with an oil lubricated compressor and a flooded evaporator, oil from the sump of a compressor can migrate to a flooded evaporator under certain low load operating conditions. Lubricant return to the compressor can be inadequate if the lubricant does not entrain with the refrigerant gas passing through the evaporator. Oil return problems occur when oil remains dissolved in the refrigerant.

Lubricant return problems have been experienced particularly in water chillers having a screw compressor with a flooded evaporator. Oil injected into the working chamber of a screw compressor, is atomized and becomes entrained in the refrigerant gas undergoing compression. Oil separators can be used in such systems to remove most of the oil that is entrained in the refrigerant gas as it leaves the compressor. However, as much as 10% of the oil continues through the refrigeration circuit until it becomes dissolved in the liquid refrigerant in the flooded evaporator. The dissolved oil accumulates in the evaporator which not only starves the compressor of needed oil, but also affects the heat exchange function of the evaporator.

SUMMARY OF THE INVENTION

It is an object of this invention to provide a lubricant composition with decreased solubility in a fluorocarbon refrigerant and increased foaming characteristics.

Another object of the invention is to provide a method for decreasing the solubility of a lubricant in a fluorocarbon refrigerant by selecting a base lubricant, adding paraffinic oil stocks and promoting the foaming of the lubricant by adding a foaming agent.

It is a further object of the invention to provide a method of using the above lubricant in a fluorocarbon refrigeration system having a flooded evaporator to facilitate oil return to the compressor.

Another object of the invention is to provide a refrigeration apparatus that offers adequate oil return from a flooded evaporator to a screw compressor.

These and other objects of the invention are provided by a novel refrigeration apparatus that includes a lubricant composition for use in a refrigeration system to foster oil return from the system's flooded evaporator to its compressor. The solubility of the lubricant in refrigerant is decreased so that an oil rich layer is formed on top of the liquid refrigerant in the evaporator. A foaming addititive in the lubricant allows a thick, stable oil foam to form when vaporizing refrigerant boils up through the oil rich layer. Carry-over of the foam through an outlet port at the top of the evaporator results in lubricant return to the compressor. This invention solves the problem of the lubricant remaining dissolved in the liquid refrigerant held in flooded evaporators by facilitating return of the lubricant to the compressor sump, thereby maintaining the proper amount of lubricant in the compressor.

DETAILED DESCRIPTION OF THE INVENTION

Figure 1:
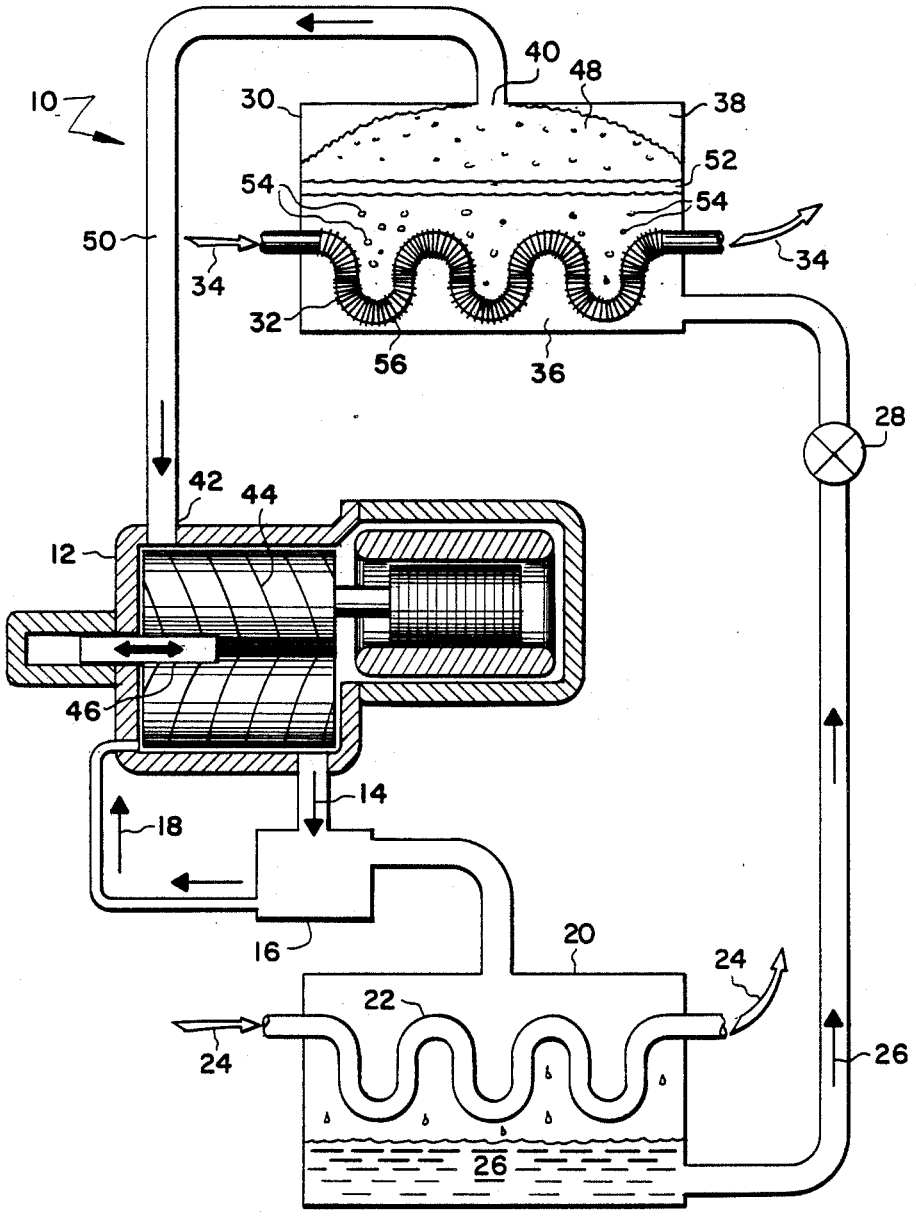
FIG. 1 is a schematic diagram of a typical refrigeration system embodying the invention.

A refrigeration system 10 embodying the invention is represented schematically in FIG. 1. A refrigeration compressor 12 discharges compressed refrigerant 14 through an oil separator 16 which attempts to remove as much lubricating oil 18 as possible from the discharged refrigerant 14. The separated oil 18 is returned to compressor 12 where it's needed, while refrigerant 14 is conveyed to a condenser 20. In condenser 20, refrigerant 14 is condensed by heat exchanger tubes 22 conveying a coolant 24. The condensed liquid refrigerant 26 leaves condenser 20 and passes through an expansion device 28 before entering a flooded evaporator 30. Expansion device 28 represents any device for reducing the refrigerant's pressure. Examples of expansion device 28 include orifice plates, capillary tubes, and expansion valves. Evaporator 30 includes heat exchanger tubes 32 conveying a working fluid 34 that is cooled by the liquid refrigerant 36. In the process of absorbing heat from the working fluid 34, the liquid refrigerant 36 vaporizes. The vaporized refrigerant 38 exits evaporator 30 through an outlet port 40 near the top of evaporator 30 and returns to a suction port 42 of compressor 12 to complete a refrigeration cycle.

Although compressor 12 is a screw compressor, compressor 12 represents other types of compressors as well, such as centrifugal compressors, scroll compressors and reciprocating compressors. However, the invention is especially useful in a refrigeration system having a screw compressor, because the relatively high need for lubrication of a screw compressor's intermeshed rotors 44 and its capacity varying slide valve 46.

Evaporator 30 is referred to as a flooded evaporator because heat exchanger tubes 32 are substantially flooded with liquid refrigerant 36. Refrigerant 36 is a fluorocarbon refrigerant such as "FREON, R-22" which is a trademark for chlorodifluoromethane. Refrigerant 36 in evaporator 30 is mixed with some oil since separator 16 is unable to completely separate all the entrained oil from refrigerant 14. To transfer the oil from evaporator 30 back to compressor 12, an oil rich foam 48 is generated which floats on top of refrigerant 36 and rises up to the outlet port 40 which is fluid communication with suction port 42 of compressor 12 by way of a suction line 50.

This oil rich foam 48 is generated by blending a base lubricant with a paraffinic oil stocks. The base lubricant provides the necessary lubricating properties for compressor 12, while the paraffinic oil stocks reduce the base lubricant's solubility in liquid refrigerant. Thus the oil composition has a tendency to separate from the liquid refrigerant 36 and produce an oil film 52 that floats on top of refrigerant 36 due to the oil's lower specific gravity. A foaming agent is added to increase the oil's tendency to foam. As the liquid refrigerant 36 is vaporized by heat exchanger tubes 32, a boiling action generates vaporous refrigerant bubbles 54 that rise upwardly through oil film 52 to produce the oil rich foam 48. The boiling action is enhanced by providing heat exchanger tubes 32 with a nucleate boiling surface 56 which in turn further promotes foam generation. The definition of nucleate boiling surface 56 is disclosed in U.S. Pat. No. 3,696,861 which is specifically incorporated by reference herein.

Figure 2:
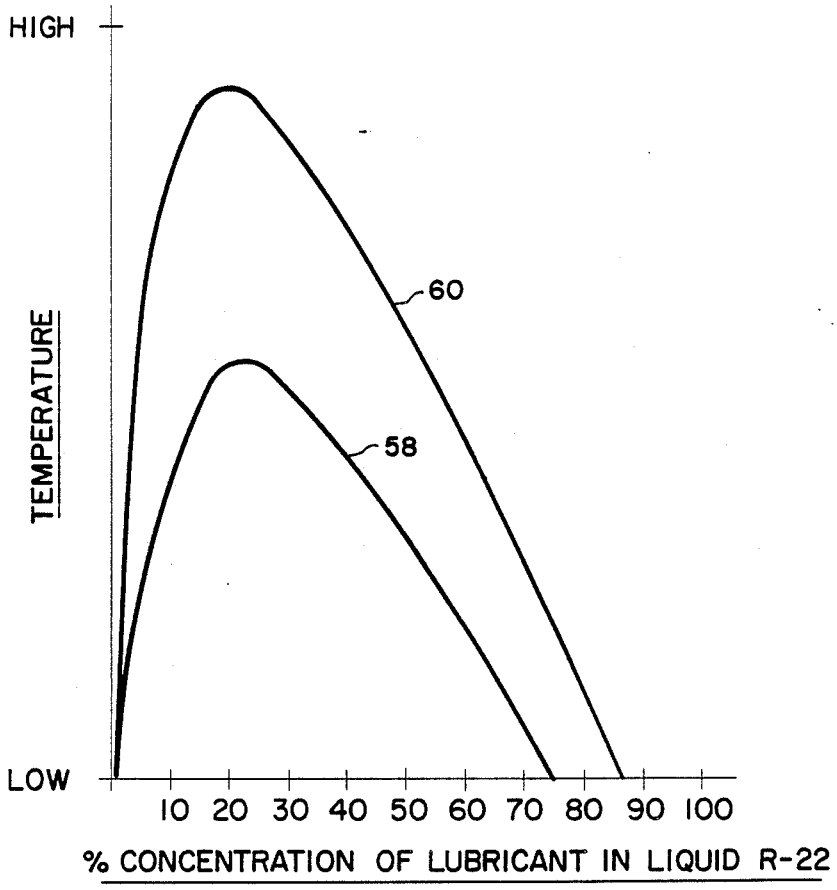
FIG. 2 is a diagram of the solubility of oil in the refrigerant, R-22, comparing the saturation temperatures of a lubricating oil and the same lubricant with a synthetic paraffinic oil blend.

A suitable base lubricant is preferably a refined mineral oil, such as those sold under the trademark "CALUMET R030". The mineral oil's solubility in R-22 is represented by saturation curve 58 of FIG. 2. Below curve 58, the refrigerant is saturated, causing some mineral oil to separate from the refrigerant. Above curve 58, the mineral oil and refrigerant produce a homogeneous mixture.

Adding paraffinic oil stocks reduces the mineral oil's solubility in the refrigerant as indicated by saturation curve 60. Likewise, above curve 60 the refrigerant mixture is homogeneous and below curve 60 the mineral oil and paraffinic oil stocks tend to separate from the refrigerant. The paraffinic oil stocks, which can be natural or synthetic, are preferably comprised of synthetic polyalphaolefin, but other paraffinic oil species may also be used, such as severely or mildly hydro-treated oils.

The combined percentage of paraffinic oil stocks and base lubricant to the refrigerant should be 4% to 8% by weight, and preferably 5% to 6%. And the proportions of paraffinic oil stocks to base lubricant should be such that the refrigerant is saturated at a temperature of 40° F. to 45° F. The percentage of paraffinic oil stocks to base lubricant should be 5% to 50% by weight.

Suitable foaming agents are organosiloxanes, such as those disclosed in U.S. Pat. No 3,792,755, which is specifically incorporated by reference herein. Dimethylpolysiloxane is one preferred organosiloxane due to its relatively low viscosity of 20 centistokes which enhances its solubility in oil. Other examples of preferred organosiloxanes include methylethylpolysiloxane, diethylpolysiloxane, and trifluoroproplemethylpolysiloxane.

The desired quantity of foaming agent is that which produces a thick, stable foam 48 as the refrigerant bubbles 54 pass through the oil rich layer 52 in evaporator 30. Foam 48 should be thick enough to reach outlet port 40 of the evaporator 30, so the oil is readily returned to compressor 12. A suitable weight concentration of the organosiloxane foaming agent, dimethylpolysiloxane, is 10 to 200 parts per million of the combined base lubricant and paraffinic oil stocks.

Although the invention is described with respect to a preferred embodiment, modifications thereto will be apparent to those skilled in the art. Therefore, the scope of the invention is to be determined by reference to the claims which follow.

We claim:

1. A refrigeration apparatus comprising:

a compressor for compressing a fluorocarbon refrigerant;

a condenser for cooling said refrigerant;

an expansion device for restricting the flow of said refrigerant;

an evaporator having a plurality of heat exchanger tubes for evaporating said refrigerant, said tubes being substantially flooded with liquid refrigerant, said evaporator having an outlet port located generally above the liquid level of said liquid refrigerant and connected in fluid communication to a suction port of said compressor;

a base lubricant mixed with said liquid refrigerant in said evaporator;

paraffinic oil stocks in said evaporator and mixed with said base lubricant and said liquid refrigerant for decreasing the solubility of said base lubricant in said liquid refrigerant, so that said lubricant has a tendency to separate from and to float on top of said liquid refrigerant; and a foaming agent mixed with said base lubricant and said paraffinic oil stocks to produce a lubricating foam in said evaporator as said refrigerant vaporizes and bubbles upwardly through said base lubricant floating on top of said liquid refrigerant, said foaming agent being of sufficient quantity to cause said lubricating foam to rise toward said outlet port of said evaporator and be readily drawn to said suction port of said compressor, whereby said lubricant is made available to lubricate said compressor.

2. The refrigeration apparatus of claim 1, wherein said heat exchanger tubes in said evaporator have a nucleate boiling surface.

3. The refrigeration apparatus of claim 1, wherein said base lubricant is a refined mineral oil.

4. The refrigeration apparatus of claim 1, wherein said paraffinic oil stocks are oils selected from the group consisting of synthetic polyalphaolefin and hydrotreated oils.

5. The refrigeration apparatus of claim 4, wherein said paraffinic oil stocks is synthetic polyalphaolefin.

6. The refrigeration apparatus of claim 1, wherein the combined weights of said paraffinic oil stocks and said base lubricant is 4% to 8% of said refrigerant, and said refrigerant is saturated with said base lubricant when said refrigerant is at a temperature of 40° F. to 45° F.

7. The refrigeration apparatus of claim 6, wherein the weight concentration of said lubricant in said refrigerant is 5% to 6%.

8. The refrigeration apparatus of claim 1, wherein the weight of said paraffinic oil stocks is 5% to 50% of the weight of said base lubricant in said refrigerant.

9. The refrigeration apparatus of claim 1, wherein said foaming agent is an organosiloxane.

10. The refrigeration apparatus of claim 9, wherein said organosiloxane is a chemical selected from the group consisting of dimethylpolysiloxanes, methylethylpolysiloxane, diethyllpolysiloxane, and trifluoropropylmethylpolysiloxane.

11. The refrigeration apparatus of claim 9, wherein said organosiloxane is dimethyllpolysiloxane.

12. The refrigeration apparatus of claim 1, wherein the proportion of said foaming agent in said refrigerant is 10 to 200 parts per million.

13. The refrigeration apparatus of claim 1, wherein said fluorocarbon refrigerant is chlorodifluoromethane (R-22).

14. The refrigeration apparatus of claim 1, wherein said compressor is a screw compressor.

15. The refrigeration apparatus of claim 14, wherein said screw compressor includes a hydraulic actuated slide valve for varying the capacity of said screw compressor.

16. A refrigeration apparatus comprising:

a screw compressor for compressing a chlorodifluoromethane refrigerant (R-22);

a condenser for cooling said refrigerant;

an expansion device for restricting the flow of said refrigerant;

an evaporator having a plurality of heat exchanger tubes for evaporating said refrigerant, said tubes being substantially flooded with liquid refrigerant, said evaporator having an outlet port located generally above the liquid level of said liquid refrigerant and connected in fluid communication to a suction port of said compressor;

a base lubricant mixed with said liquid refrigerant in said evaporator;

paraffinic oil stocks in said evaporator and mixed with said base lubricant and said liquid refrigerant for decreasing the solubility of said base lubricant in said liquid refrigerant, so that said lubricant has a tendency to separate from and to float on top of said liquid refrigerant;

a foaming agent mixed with said base lubricant and said paraffinic oil stocks to produce a lubricating foam in said evaporator as said refrigerant vaporizes and bubbles upwardly through said base lubricant floating on top of said liquid refrigerant, said foaming agent being of sufficient quantity to cause said lubricating foam to rise toward said outlet port of said evaporator and be readily drawn to said suction port of said compressor, whereby said lubricant is made available to lubricate said compressor; and an oil separator for separating some of said lubricant from refrigerant discharged from said compressor and for returning some of said lubricant back to said compressor.

17. The refrigeration apparatus as recited in claim 16, wherein said heat exchanger tubes in said evaporator have a nucleate boiling surface.

18. The refrigeration apparatus of claim 16, wherein said base lubricant is a refined mineral oil.

19. The refrigeration apparatus of claim 16, wherein said paraffinic oil stocks are oils selected from the group consisting of synthetic polyalphaolefin and hydrotreated oils.

20. The refrigeration apparatus of claim 19, wherein said paraffinic oil stocks is synthetic polyalphaolefin.

21. The refrigeration apparatus of claim 16, wherein the combined weights of said paraffinic oil stocks and said base lubricant is 4% to 8% of said refrigerant, and said refrigerant is saturated with said base lubricant when said refrigerant is at a temperature of 40° F. to 45° F.

22. The refrigeration apparatus of claim 21, wherein the weight concentration of said lubricant in said refrigerant is 5% to 6%.

23. The refrigeration apparatus of claim 16, wherein the weight of said paraffinic oil stocks is 5% to 50% of the weight of said base lubricant in said refrigerant.

24. The refrigeration apparatus of claim 16, wherein said foaming agent is an organosiloxane.

25. The refrigeration apparatus of claim 24, wherein said organosiloxane is a chemical selected from the group consisting of dimethylpolysiloxanes, methylethylpolysiloxane, diethyllpolysiloxane, and trifluoropropylmethylpolysiloxane.

26. The refrigeration apparatus of claim 24, wherein said organosiloxane is dimethyllpolysiloxane.

27. The refrigeration apparatus of claim 16, wherein the proportion of said foaming agent in said refrigerant is 10 to 200 parts per million.

28. The refrigeration apparatus of claim 16, wherein said screw compressor includes a hydraulic actuated slide valve for varying the capacity of said screw compressor.

29. A refrigeration apparatus comprising:

a screw compressor for compressing a chlorodifluoromethane refrigerant (R-22);

a condenser for cooling said refrigerant;

an expansion device for restricting the flow of said refrigerant;

an evaporator having a plurality of heat exchanger tubes for evaporating said refrigerant, said tubes being substantially flooded with liquid refrigerant and having a nucleate boiling surface, said evaporator having an outlet port located generally above the liquid level of said liquid refrigerant and connected in fluid communication to a suction port of said compressor;

a base lubricant of refined mineral oil mixed with said liquid refrigerant in said evaporator;

paraffinic oil stocks of synthetic polyalphaolefin in said evaporator and mixed with said base lubricant and said liquid refrigerant for decreasing the solubility of said base lubricant in said liquid refrigerant, so that said lubricant has a tendency to separate from and to float on top of said liquid refrigerant; and a foaming agent of organosiloxane mixed with said base lubricant and said paraffinic oil stocks to produce a lubricating foam in said evaporator as said refrigerant vaporizes and bubbles upwardly through said base lubricant floating on top of said liquid refrigerant, said foaming agent being less than 200 parts per million of lubricant to cause said lubricating foam to rise toward said outlet port of said evaporator and be readily drawn to said suction port of said compressor, whereby said lubricant is made available to lubricate said compressor.

30. The refrigeration apparatus of claim 27, wherein the combined weights of said paraffinic oil stocks and said base lubricant is 4% to 8% of said refrigerant, and said refrigerant is saturated with said base lubricant when said refrigerant is at a temperature of 40° F. to 45° F.

31. The refrigeration apparatus of claim 28, wherein the weight concentration of said lubricant in said refrigerant is 5% to 6%.

32. The refrigeration apparatus of claim 27, wherein the weight of said paraffinic oil stocks is 5% to 50% of the weight of said base lubricant in said refrigerant.

33. The refrigeration apparatus of claim 27, wherein said organosiloxane is a chemical selected from the group consisting of dimethylpolysiloxanes, methylethylpolysiloxane, diethyllpolysiloxane, and trifluoropropylmethylpolysiloxane.

34. The refrigeration apparatus of claim 27, wherein said organosiloxane is dimethyllpolysiloxane.

35. The refrigeration apparatus of claim 27, wherein said screw compressor includes a hydraulic actuated slide valve for varying the capacity of said screw compressor.

* * * * *